US005769974A

United States Patent [19]

Masteller et al.

[11] Patent Number: 5,769,974

[45] Date of Patent: Jun. 23, 1998

[54] PROCESS FOR IMPROVING MAGNETIC PERFORMANCE IN A FREE-MACHINING FERRITIC STAINLESS STEEL

[75] Inventors: Millard S. Masteller, Fleetwood; Bradford A. Dulmaine, Reading, both of Pa.

[73] Assignee: CRS Holdings, Inc., Wilmington, Del.

[21] Appl. No.: 792,061

[22] Filed: Feb. 3, 1997

[51] Int. Cl.[6] ..... C21D 8/00

[52] U.S. Cl. ..... 148/651; 148/120; 148/624; 148/651

[58] Field of Search ..... 148/120, 609, 148/621, 624, 650, 651

[56] References Cited

U.S. PATENT DOCUMENTS

| | | | |
|---|---|---|---|
| 3,923,560 | 12/1975 | Regitz . | |
| 4,244,754 | 1/1981 | Masumoto et al. | 148/621 |
| 4,390,378 | 6/1983 | Rastogi . | |
| 4,394,192 | 7/1983 | Rastogi . | |
| 4,421,574 | 12/1983 | Lyudkovsky . | |
| 4,601,766 | 7/1986 | Rastogi et al. . | |
| 4,772,341 | 9/1988 | Rastogi et al. . | |
| 5,091,024 | 2/1992 | DeBold et al. . | |

FOREIGN PATENT DOCUMENTS

| | | | |
|---|---|---|---|
| 64-25915 | 1/1989 | Japan | 148/650 |
| 3-285017 | 12/1991 | Japan | 148/651 |

OTHER PUBLICATIONS

"Standard Specification for Low–Carbon Magnetic Iron", ASTM Designation: A 848/A848M–96 pp. 1–5 (1996).

"REMKO Soft Magnetic Iron", Technical Bulletin, Uddeholm Corporation, Totowa, NJ (1988).

*Primary Examiner*—John Sheehan

*Attorney, Agent, or Firm*—Dann, Dorfman, Herrell and Skillman, P.C.

[57] ABSTRACT

A method for making a corrosion resistant, ferritic steel alloy, with reduced magnetic coercivity is disclosed. The process includes the step of providing an intermediate form of a ferritic alloy consisting essentially of, in weight percent, about

| | |
|---|---|
| Carbon | 0.02 max. |
| Manganese | 1.5 max. |
| Silicon | 3.0 max. |
| Phosphorus | 0.03 max. |
| Sulfur | 0.1–0.5 |
| Chromium | 8–20 |
| Nickel | 0.60 max. |
| Molybdenum | 1.5 max. |
| Copper | 0.3 max. |
| Cobalt | 0.10 max. |
| Aluminum | 0.01 max. |
| Titanium | 0.01 max. |
| Nitrogen | 0.02 max. |
| Iron | Balance |

The intermediate form of the alloy is given an annealing heat treatment at a first temperature in the range of about 700°–900° C. for at least about 2 hours. After the penultimate annealing step, the intermediate form is cold worked to reduce its cross-sectional area by about 10–25%, thereby providing an elongated form of said alloy. The elongated form is then given a final annealing heat treatment at a second temperature in the range of about 750°–1050° C. for at least about 4 hours. Parts prepared in accordance with the disclosed process are fully ferritic and exhibit a coercivity significantly less than 2.0 Oe.

8 Claims, No Drawings

PROCESS FOR IMPROVING MAGNETIC PERFORMANCE IN A FREE-MACHINING FERRITIC STAINLESS STEEL

FIELD OF THE INVENTION

This intention relates to ferritic stainless steels and in particular to a process for making such steels so that they provide improved magnetic properties compared to the known ferritic stainless steels.

BACKGROUND OF THE INVENTION

Today's automobiles often include such state-of-the-art technologies as electronic fuel injection systems, anti-lock braking systems, and automatically adjusting suspension systems. Those systems contain electromagnetically operated components that require soft magnetic materials. Low coercivity and high magnetic saturation induction are desirable for good performance of such components. The magnetic materials used must also be corrosion resistant because automobiles are typically exposed to corrosive environments having high relative humidity and/or saline atmospheres. The need for good corrosion resistance is of particular importance in automotive fuel injection systems in view of the increasing use of ethanol- and methanol-containing fuels, which are known to be more corrosive than traditional automotive fuels.

The magnetic components used in the above-mentioned systems are machined from standard stock forms such as bar, wire, rod, or strip. Therefore, it is highly desirable that the materials used be relatively easy to machine. Ferritic stainless steels are known which provide a combination of corrosion resistance, good magnetic properties, and good machinability in the as-worked and annealed condition. However, as the demand for better reliability in state-of-the-art automotive systems has increased, so has the demand for better magnetic performance from the materials used to make the magnetic components for those systems.

Hitherto, one solution to the problem of providing improved magnetic performance in a ferritic stainless steel was to reduce the amounts of carbon, nitrogen, and sulfur in such steels. The presence of sulfides, carbides, and nitrides impairs the magnetic performance of a corrosion resistant ferritic alloy directly by impeding domain wall motion and indirectly by restricting grain growth during heat treatment. Magnetic performance is impaired because those effects undesirably increase the coercivity of a ferritic stainless steel. In practice, however, it has been found that such compositional restrictions are effective only when the levels of sulfur, carbon, and nitrogen are reduced so low as to make it prohibitively expensive to produce such steels. Another approach has been to include small amounts of lead in a ferritic stainless steel. While leaded grades of ferritic stainless steels provide good magnetic performance, the use of lead adversely affects the hot workability of such steels and is highly undesirable for health and environmental reasons.

In view of the difficulties encountered in trying to improve the magnetic performance of free machining, ferritic stainless steels by compositional modifications, it appears that another approach to solving the problem is needed.

SUMMARY OF THE INVENTION

The problem of providing a lead-free, corrosion resistant, free machining ferritic steel alloy with improved magnetic performance relative to the known free machining, lead-free ferritic stainless steels is solved to a large degree by preparing a ferritic stainless steel with the process according to the present invention. The process of the present invention begins by providing an intermediate form of a ferritic stainless steel alloy. The alloy contains, in weight percent, about

| | |
|---|---|
| Carbon | 0.02 max. |
| Manganese | 1.5 max. |
| Silicon | 3.0 max. |
| Phosphorus | 0.03 max. |
| Sulfur | 0.1–0.5 |
| Chromium | 8–20 |
| Nickel | 0.60 max. |
| Molybdenum | 1.5 max. |
| Copper | 0.3 max. |
| Cobalt | 0.10 max. |
| Aluminum | 0.01 max. |
| Titanium | 0.01 max. |
| Nitrogen | 0.02 max. |
| Iron | Balance. |

The alloy is melted and refined so as to be essentially free of lead. The intermediate form of the alloy is annealed at a temperature in the range of about 700°–900° C. for at least about 2 hours and cooled to room temperature. Thereafter, the annealed intermediate form is cold-worked to reduce its cross-sectional area by at least about 10%, but not more than about 25%, so as to provide an elongated form of the aforesaid alloy having a desired final cross-sectional area. The elongated form is then annealed at a temperature in the range of about 750°–1050° C. for at least about 4 hours whereby it obtains the desired magnetic properties.

Here and throughout this application, the term "percent" or the symbol "%" means percent by weight unless otherwise indicated.

DETAILED DESCRIPTION

The process according to the present invention is used with a wide variety of corrosion resistant, ferritic steel alloys. A suitable alloy contains, at least about 8%, preferably at least about 11%, and better yet, at least about 12.5% chromium to provide the desired level of corrosion resistance in environments usually encountered by automobiles. Chromium also contributes to the electrical resistivity of the alloy. Although the ferritic stainless steel alloy can contain up to 20% chromium, it is preferable that the amount of chromium be limited to not more than about 13.5% to obtain the highest magnetic saturation induction.

Up to about 1.5% molybdenum can be present in the alloy because it contributes to the corrosion resistance of the alloy in a variety of corrosive environments such as fuels containing methanol or ethanol, chloride-containing environments, environments containing such pollutants as $CO_2$ and $H_2S$, and acidic environments containing for example, acetic or dilute sulfuric acid. When present, molybdenum also benefits the electrical resistivity of the alloy. Preferably the alloy contains at least about 0.2 or 0.3% molybdenum. Too much molybdenum, like chromium, adversely affects the magnetic induction of the alloy. Therefore, molybdenum is preferably restricted to not more than about 1.0%, and better yet to not more than about 0.5%.

At least about 0.1% sulfur is present in the alloy to benefit machinability. However, because sulfur tends to form sulfides that adversely affect the magnetic properties of the alloy, particularly its coercivity, sulfur is restricted to not more than about 0.5%, and preferably to not more than about 0.2% or 0.3%.

A small amount of manganese, typically at least about 0.2% or 0.30%, is present in the alloy because it contributes to the hot workability of the alloy. Manganese also combines with some of the sulfur to form manganese-rich sulfides which benefit the machinability of the alloy. However, too much manganese present in such sulfides adversely affects the corrosion resistance of the alloy. Moreover, the formation of too many manganese sulfides adversely affects the magnetic properties of the alloy as noted above. Therefore, not more than about 1.5%, and preferably not more than about 1.0% manganese is present in the alloy. For the best magnetic properties, the alloy contains not more than about 0.8%, and better yet, not more than about 0.6% manganese.

Silicon stabilizes ferrite in the alloy and is beneficial for good electrical resistivity. For those reasons the alloy contains a small amount of silicon up to about 3.0%. Preferably at least about 0.5%, and better yet, at least about 0.8% silicon is present in the alloy to ensure the benefits derived from its presence. Too much silicon adversely affects the cold workability of the alloy, however, and therefore, silicon is preferably restricted to not more than about 2.00%, and for best results, to not more than about 1.50% in this alloy. For those uses where high electrical resistivity is not required, silicon is present for deoxidizing the alloy during melting and refining. In such case, the retained amount is typically not more than about 0.5%.

The balance of the alloy is iron and the usual impurities found in commercial grades of ferritic stainless steel alloys intended for the same or similar service or use. The amounts of such impurities are controlled so that they do not adversely affect the desired magnetic performance of the alloy, particularly the coercivity ($H_c$). To that end, carbon and nitrogen are each restricted to not more than about 0.02%, preferably to not more than about 0.015%. Phosphorus is limited to about 0.03% max., preferably to not more than about 0.02%. Titanium and aluminum combine with carbon and/or nitrogen and/or oxygen to form carbides, nitrides, and oxides that adversely affect the magnetic performance of the alloy by restricting grain growth and by impeding magnetic domain wall motion. The oxides formed by aluminum and titanium adversely affect the machinability of the alloy. Titanium also forms sulfides that adversely affect the alloy's magnetic properties. For those reasons, titanium and aluminum are restricted to not more than about 0.02%, preferably to not more than about 0.01%, and better yet, to not more than about 0.005% each. Nickel is preferably limited to not more than about 0.5%, and better yet to not more than about 0.2%. Copper is restricted to not more than about 0.30%, preferably not more than about 0.20%; and cobalt is restricted to not more than about 0.20%, preferably to not more than about 0.10%. Such elements as lead and tellurium, although known to be beneficial for machinability, are not desirable because of their adverse effect on health and the environment. Therefore, lead and tellurium are restricted to trace amounts of not more than about twenty parts per million (20 ppm) each.

The intermediate form of the alloy can be prepared by any convenient melting technique. However, the alloy is preferably melted in an electric arc furnace and refined by the argon-oxygen decarburization process (AOD). The alloy is usually cast into an ingot form. However, the molten alloy can be cast in a continuous caster to directly provide an elongated form. The ingot or the continuously cast billet is hot worked, as by pressing, cogging, or rolling, from a temperature in the range of about 1100°–1200° C. to a first intermediate size billet. The alloy is preferably normalized after hot working under time and temperature conditions selected with regard to the size and cross section of the hot worked billet. For example, a billet having a thickness of up to about 2 in (5.08 cm) is normalized by heating at about 1000° C. for at least 1 hour and then cooling in air. The billet is then hot and/or cold worked to reduce its cross sectional area. When the alloy is cold worked, intermediate annealing steps are conducted between successive cold reductions as necessary in keeping with good commercial practice. Where the appropriate equipment is available, the foregoing steps can be avoided by casting the molten alloy directly into the form of strip or wire. The intermediate form of the alloy can also be made using powder metallurgy techniques.

Regardless of the method used to make the intermediate form of the alloy, the alloy is mechanically worked to provide an elongated form having a penultimate cross-sectional dimension that permits the final cross-sectional size of the finished form to be obtained in a single cold reduction step of about 10–25% preferably about 10–20%, reduction in cross-sectional area (RCSA). This final cold reduction step may be accomplished in one or more passes, but when multiple passes are employed, there is no annealing between consecutive passes. After the intermediate form of the alloy has been reduced to the penultimate cross-sectional dimension, and before it is cold worked to final cross-sectional dimension, it is annealed at a temperature in the range of about 700°–900° C. for at least about 2 hours and then cooled to room temperature. Preferably, this penultimate anneal is conducted at a temperature in the range of about 750°–850° C.

Cold working of the intermediate form to final cross-sectional dimension is carried out by any known technique including rolling, drawing, swaging, stretching, or bending. As indicated above, the cold-working step is performed so as to provide no more than a 10–25% reduction in cross-sectional area of the intermediate form. In some instances it may be advantageous to further reduce the outside dimension(s) of the as-cold-worked alloy by machining or by such surface finishing techniques as grinding or shaving in order to ensure that the final cold reduction is within the specified range. Typically, the as-cold-worked alloy is machined into parts for automotive systems such as electronic fuel injectors, antilock braking systems, and electronic suspension adjustment systems.

After the final cold reduction, and subsequent to any machining, the elongated form, or a part machined therefrom, is heat treated for optimum magnetic performance by annealing for at least 4 hours at a temperature in the range of about 700°–1050° C., preferably about 800°–900° C. The annealing time and temperature are selected based on the actual composition and part size to provide a fully ferritic structure preferably having a grain size of ASTM 4–5 or coarser. Cooling from the annealing temperature is carried out at a slow rate to avoid residual stress in the annealed alloy or part. Good results are obtained with a cooling rate of about 80°–110 C°/hour.

EXAMPLES

Alloy A having the weight percent composition set forth in Table 1 below was prepared and processed in accordance with the present invention.

TABLE 1

| C | Mn | Si | P | S | Cr | Ni | Mo | Cu | Co | Al | N | O | Se | Fe |
|---|---|---|---|---|---|---|---|---|---|---|---|---|---|---|
| 0.011 | 0.42 | 0.94 | 0.016 | 0.14 | 13.02 | 0.11 | 0.26 | 0.04 | 0.03 | <0.004 | 0.018 | — | — | Bal. |

Alloy A was arc melted, refined using the argon oxygen decarburization process (AOD), and cast into four (4) 19 in. square ingots. The ingots were cogged to 5 in. square billets in two passes. The billets were hot rolled to the following bar sizes: 0.3593 in. diam. (2 each), 0.3750 in. diam., and 0.3906 in. diam. The hot rolled bars were shaved to provide the following penultimate dimensions: 0.3390 in. diam., 0.3490 in. diam., 0.3600 in. diam., and 0.3720 in. diam. The penultimate dimensions were selected so that the final cross-sectional dimension could be obtained in single cold-reduction steps of 10% RCSA, 15% RCSA, 20% RCSA, and 25% RCSA, respectively. The bars were given a penultimate annealing heat treatment at 820° C. for 2 hours and then cooled to room temperature. Each of the annealed bars was cold drawn to 0.322 in. round and ground to a finish dimension of 0.315 in. round.

Four 3 in. long pieces and four 10 in. long pieces were cut from each of the cold worked bars. One 3 in. piece and one 10 in. piece from each of the cold-worked bars were annealed in dry hydrogen for 4 hours at each of the following temperatures: 754° C., 854° C., 954° C., and 1054° C. In each case the annealed pieces were cooled at 100° C. per hour from the annealing temperature.

Shown in Table 2 are the results of magnetic testing of the annealed specimens including the coercivity ($H_c$) in oersteds (Oe), the magnetic induction at a magnetization of 2 Oe, 3 Oe, 5 Oe, and 30 Oe, ($B_2$, $B_3$, $B_5$, and $B_{30}$, respectively) in kilogauss (kG), and the remanent induction from a maximum magnetic field strength of 30 Oe ($B_{R\ 30}$). The percent reduction in cross-sectional area (%RCSA) and the final annealing temperature (Temp.) in °C. are also shown in Table 2 for easy reference.

TABLE 2

| % RCSA | Temp. | $H_c$ | $B_2$ | $B_3$ | $B_5$ | $B_{30}$ | $B_{R\ 30}$ |
|---|---|---|---|---|---|---|---|
| 10 | 754° C. | 1.31 | 9.2 | 11.3 | 12.6 | 14.5 | 12.9 |
| 15 | | 1.36 | 6.9 | 9.1 | 11.8 | 14.3 | 12.4 |
| 20 | | 1.53 | 6.3 | 9.1 | 11.6 | 14.1 | 11.7 |
| 25 | | 1.47 | 7.4 | 10.7 | 12.2 | 14.2 | 11.3 |
| 10 | 854° C. | 1.29 | 8.3 | 11.2 | 12.7 | 14.6 | 12.8 |
| 15 | | 1.34 | 8.4 | 11.1 | 12.4 | 14.3 | 12.6 |
| 20 | | 1.51 | 8.0 | 10.8 | 12.1 | 14.0 | 12.5 |
| 25 | | 1.47 | 5.8 | 7.9 | 10.6 | 14.2 | 12.8 |
| 10 | 954° C. | 1.74 | 4.3 | 6.0 | 8.0 | 14.3 | 8.6 |
| 15 | | 1.71 | 4.0 | 5.6 | 7.5 | 14.2 | 7.1 |
| 20 | | 1.83 | 3.5 | 7.0 | 10.7 | 14.0 | 9.8 |
| 25Z | | 1.92 | 3.9 | 5.7 | 7.6 | 14.0 | 10.2 |
| 10 | 1054° C. | 1.51 | 3.9 | 5.0 | 6.4 | 12.9 | 6.8 |
| 15 | | 1.52 | 3.5 | 4.6 | 6.0 | 12.1 | 9.8 |
| 20 | | 1.60 | 3.9 | 5.6 | 7.6 | 14.0 | 9.7 |
| 25 | | 1.75 | 3.4 | 4.9 | 6.4 | 13.2 | 9.2 |

It can be seen from Table 2 that the process according to the present invention provides material having very low coercivity. In fact, the preferred processing conditions provided the lowest values of coercivity in the tested specimens. The significance of the results shown in Table 2 will be apparent from the fact that corrosion resistant, ferritic steel alloys which are prepared in a conventional manner provide much higher values of coercivity, typically 2.0 Oe or more.

The terms and expressions which have been employed herein are used as terms of description, not of limitation. There is no intention in the use of such terms and expressions of excluding any equivalents of the features shown and described or portions thereof. However, it is recognized that various modifications are possible within the scope of the invention claimed.

What is claimed is:

1. A method for making a free machining corrosion resistant, ferritic, steel alloy, comprising the steps of:

providing an intermediate form of a ferritic alloy consisting essentially of, in weight percent, about

| | |
|---|---|
| Carbon | 0.02 max. |
| Manganese | 1.5 max. |
| Silicon | 3.0 max. |
| Phosphorus | 0.03 max. |
| Sulfur | 0.1–0.5 |
| Chromium | 8–20 |
| Nickel | 0.60 max. |
| Molybdenum | 1.5 max. |
| Copper | 0.3 max. |
| Cobalt | 0.10 max. |
| Aluminum | 0.01 max. |
| Titanium | 0.01 max. |
| Nitrogen | 0.02 max. |

and the balance being essentially iron;

annealing said intermediate form of said alloy at a first temperature in the range of about 700°–900° C. for at least about 2 hours;

cold working said annealed intermediate form to reduce the cross-sectional area thereof by about 10–25%, thereby providing an elongated form of said alloy; and then annealing said elongated form at a second temperature in the range of about 750°–1050° C. for at least about 4 hours.

2. A method as set forth in claim 1 comprising the step of cooling the elongated form from the second annealing temperature at a cooling rate of about 80°–110° C. per hour to avoid residual stresses in the elongated form.

3. A method as set forth in claim 1 wherein the step of providing the intermediate form of the ferritic alloy comprises the step of mechanically working the alloy to provide an elongated form having a penultimate cross-sectional area such that the cold working step can be accomplished in a single cold reduction step.

4. A method as set forth in claim 1 wherein the corrosion resistant, ferritic alloy contains:

| | |
|---|---|
| Carbon | 0.015 max. |
| Manganese | 0.20–1.0 |
| Silicon | 0.80–1.50 |
| Phosphorus | 0.025 max. |
| Chromium | 12.80–13.20 |
| Nickel | 0.40 max. |
| Molybdenum | 0.20–0.40 |
| Copper | 0.20 max. |
| Cobalt | 0.10 max. |
| Aluminum | 0.010 max. |
| Titanium | 0.010 max. |
| Nitrogen | 0.020 max. |

5. A method as recited in claim 1 wherein the intermediate form of the ferritic alloy is annealed at a first temperature in the range of 750°–850° C.

6. A method as recited in claim 1 wherein the elongated form of the ferritic alloy is annealed at a second temperature in the range of 800°–900° C.

7. A method as recited in claim 1 wherein the step of cold working the intermediate form consists of reducing the cross-sectional area thereof by not more than about 20%.

8. A method for making a free machining corrosion resistant, ferritic steel alloy, comprising the steps of:

providing an intermediate form of a ferritic alloy consisting essentially of, in weight percent, about

| | |
|---|---|
| Carbon | 0.015 max. |
| Manganese | 0.30–0.80 |
| Silicon | 0.80–1.50 |
| Phosphorus | 0.025 max. |
| Sulfur | 0.1–0.3 |
| Chromium | 12.5–13.5 |
| Nickel | 0.40 max. |
| Molybdenum | 0.20–0.40 |
| Copper | 0.20 max. |

-continued

| | |
|---|---|
| Cobalt | 0.10 max. |
| Aluminum | 0.010 max. |
| Titanium | 0.010 max. |
| Nitrogen | 0.020 max. |

and the balance being essentially iron;

annealing said intermediate form of said alloy at a first temperature in the range of about 750°–850° C. for at least about 2 hours;

cold working said annealed intermediate form to reduce the cross-sectional area thereof by about 10–25%, thereby providing an elongated form of said alloy; and then annealing said elongated form at a second temperature in the range of about 800°–900° C. for at least about 4 hours.

* * * * *